US006195112B1

(12) United States Patent
Fassler et al.

(10) Patent No.: US 6,195,112 B1
(45) **Date of Patent: *Feb. 27, 2001**

(54) STEERING APPARATUS FOR RE-INKABLE BELT

(75) Inventors: Werner Fassler, Rochester; Charles D. DeBoer, Palmyra; James E. Pickering, Bloomfield, all of NY (US)

(73) Assignee: Eastman Kodak Company, Rochester, NY (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/116,168

(22) Filed: Jul. 16, 1998

(51) Int. Cl.[7] ..... B41J 15/16; B41J 35/08

(52) U.S. Cl. ..... 347/219; 400/579; 226/15; 226/18

(58) Field of Search ..... 400/579; 226/15, 226/18; 347/219, 197, 198

(56) References Cited

U.S. PATENT DOCUMENTS

| | | |
|---|---|---|
| 4,315,983 | 2/1982 | Kawamura et al. . |
| 4,415,621 | 11/1983 | Specht et al. . |
| 4,508,811 | 4/1985 | Gravesteijn et al. . |
| 4,582,776 | 4/1986 | Matsui et al. . |
| 4,656,121 | 4/1987 | Sato et al. . |
| 4,661,393 | 4/1987 | Uchiyama et al. . |
| 4,833,124 | 5/1989 | Lum . |
| 4,912,083 | 3/1990 | Chapman et al. . |
| 4,942,141 | 7/1990 | DeBoer et al. . |
| 4,948,776 | 8/1990 | Evans et al. . |
| 4,948,777 | 8/1990 | Evans et al. . |
| 4,948,778 | 8/1990 | DeBoer . |
| 4,950,639 | 8/1990 | DeBoer . |
| 4,952,552 | 8/1990 | Chapman et al. . |
| 5,023,229 | 6/1991 | Evans et al. . |
| 5,024,990 | 6/1991 | Chapman et al. . |
| 5,043,318 | 8/1991 | Kawakami et al. . |
| 5,118,657 | 6/1992 | Kawakami et al. . |
| 5,137,382 | 8/1992 | Miyajima . |
| 5,156,938 | 10/1992 | Foley et al. . |

(List continued on next page.)

FOREIGN PATENT DOCUMENTS

568993 A2 5/1993 (EP) .

OTHER PUBLICATIONS

IBM Technical Disclosure Bulletion, "Continuous Web Servo System", vol. 31, No. 10, pp 417–418, Mar. 1989.*
Matsuoka, M., Infrared Absorbing Dyes, Plenum Press, New York, 1990.
Pigment Handbook; Lewis, P. A., Ed.; Wiley, New York, 1988.

*Primary Examiner*—Huan Tran
(74) *Attorney, Agent, or Firm*—Raymond L. Owens

(57) ABSTRACT

Apparatus for color printing on a re-inkable belt, the re-inkable belt being moveable along an endless path and trained about a transport roller and including an ink transfer layer where an ink can be transferred to a moveable receiver and the moveable receiver moves into ink transfer relationship with the re-inkable belt at a nip position for transferring ink imagewise from the re-inkable belt to the receiver. The depleted ink is replenished and the re-inkable belt is arranged so that ink will be diffused into the ink transfer surface, and tension is adjustedly applied at two spaced locations to the transport roller and including two spaced steering actuators which, when actuated, apply tension to opposite positions on the transport roller, a sensor for determining the position of the re-inkable belt, and a computer coupled to the sensor for selectively actuating the steering actuators so as to apply tension to the transport roller which compensates for lateral distortion of the re-inkable belt.

1 Claim, 3 Drawing Sheets

U.S. PATENT DOCUMENTS

| | | | |
|---|---|---|---|
| 5,286,521 | | 2/1994 | Matsuda et al. . |
| 5,286,604 | | 2/1994 | Simmons . |
| 5,334,574 | | 8/1994 | Matsuda et al. . |
| 5,340,699 | | 8/1994 | Haley et al. . |
| 5,351,617 | | 10/1994 | Williams et al. . |
| 5,360,694 | | 11/1994 | Thien et al. . |
| 5,401,607 | | 3/1995 | Takiff et al. . |
| 5,491,046 | | 2/1996 | DeBoer et al. . |
| 5,558,263 | * | 9/1996 | Long ..... 226/15 |
| 5,611,847 | | 3/1997 | Guistina et al. . |
| 5,679,139 | | 10/1997 | McInerney et al. . |
| 5,679,141 | | 10/1997 | McInerney et al. . |
| 5,679,142 | | 10/1997 | McInerney et al. . |
| 5,692,844 | | 12/1997 | Harrison et al. . |
| 5,698,018 | | 12/1997 | Bishop et al. . |

* cited by examiner

STEERING APPARATUS FOR RE-INKABLE BELT

CROSS REFERENCE TO RELATED APPLICATIONS

Reference is made to commonly assigned U.S. patent application Ser. No. 09/116,412, filed Jul. 16, 1998 entitled "Image-Wise Re-Inkable Belt" in the name of Weiner Fassler et al. The disclosure of this related application is incorporated herein by reference.

FIELD OF THE INVENTION

This invention relates to compensating for stresses caused on a re-inkable endless belt during a thermal printing process.

BACKGROUND OF THE INVENTION

Color transfer thermal printers use a color donor member that may be a sheet, but usually is in the form of a web advanced from a supply roll to a take-up roll. The color donor member passes between a print head and a dye receiver member. The thermal print head comprises a linear array of resistive heat elements. In operation, the resistive heat elements of the print head are selectively energized in accordance with data from a print head control circuit. As a result, the image defined by the data from the print head control circuit is placed on the receiver member.

A significant problem in this technology is that the color donor members used to make the thermal prints are generally intended for single (one time) use. Thus, although the member has at least three times the area of the final print and contains enough colorant to make a solid black image, only a small fraction of the color is ever used.

After printing an image, the color donor cannot be easily reused, although this has been the subject of several patents. The primary reason that inhibits reuse of the color donor is that the color transfer process is very sensitive to the concentration of the colorant in the donor layer. During the first printing operation, color is selectively removed from the layer thus altering its concentration. In subsequent printings, regions of the donor that had been previously imaged have lower transfer efficiency than regions that were not imaged. This results in a ghost image appearing in subsequent prints.

The cost associated with having a single use donor ribbon is large because of the large area of ribbon required, as well as the large excess of colorant coated on the donor member. While this technology is able to produce high quality continuous tone prints, it is desired to provide an approach which has all of the good attributes of thermal color transfer imaging but without the limitations associated with single use donor members.

Some work has been done by others to accomplish similar goals. For example, U.S. Pat. No. 5,286,521 discusses a reusable wax transfer ink donor ribbon. This process is intended to provide a dye donor ribbon that may be used to print more than one page before the ribbon is completely consumed. U.S. Pat. No. 4,661,393 describes a reusable ink ribbon, again for wax transfer printing. U.S. Pat. No. 5,137,382 discloses a printer device capable of re-inking a thermal transfer ribbon. However, again the technology is wax transfer rather than dye transfer. In the device, solid wax is melted and transferred using a roller onto the reusable transfer ribbon. U.S. Pat. No. 5,334,574 describes a reusable dye donor ribbon for thermal dye transfer printing. This reusable ribbon has multiple layers containing dye which limit the diffusion of dye out of the donor sheet. This enables the ribbon to be used to make multiple prints. In addition, the ribbon may be run at a slower speed than the dye receiver sheet, enabling additional utilization. U.S. Pat. No. 5,118,657 describes a multiple use thermal dye transfer ink ribbon. This ribbon has a high concentration dye layer on the bottom and low concentration dye layer on the top. The low concentration dye layer meters or controls dye transfer out of the ribbon. This enables the ribbon to be used multiple times. U.S. Pat. No. 5,043,318 is another example of a thermal dye transfer ribbon that can be used multiple times.

SUMMARY OF THE INVENTION

The present invention has recognized that when endless re-inkable belts are used, stresses can cause positional distortion of the belt and these distortions should be corrected.

An object of this invention is to provide an apparatus for steering and controlling the position of a re-inkable belt for thermal printing to compensate for stresses on the re-inkable belt.

This object is achieved by color printing apparatus for compensating for lateral distortion of a re-inkable belt, the re-inkable belt being moveable along an endless path and trained about a transport roller and including an ink transfer layer where an ink can be transferred to a moveable receiver and replenished in the endless belt comprising:

a) means for causing the moveable receiver to move into ink transfer relationship with the re-inkable belt at a nip position for transferring ink imagewise from the re-inkable belt to the receiver;

b) means for replenishing depleted ink on the re-inkable belt; and c) means for adjustedly applying tension at two spaced locations to the transport roller and including two spaced steering actuators which, when respectively actuated, selectively displaces the transport roller at opposite positions, a sensor for determining the position of the re-inkable belt, and means coupled to the sensor for selectively actuating the steering actuators so as to move the transport roller to laterally position the re-inkable belt along the surface of the transport roller to compensate for lateral distortion of the re-inkable belt.

ADVANTAGES

An advantage of this invention is that a re-inkable belt can be more effectively used for transferring inks to a receiver producing images that have high resolution and are of continuous tone by compensating for lateral movement of the re-inkable belt caused by stress from temperature and environmental changes.

Another advantage of the present invention is that the re-inkable belt can be used for more prints without replacement because of thermal distortion of the belt.

A feature of this invention is that the images can be inexpensively produced because the re-inkable belt is re-useable for more prints and there are no wasted colorants.

DETAILED DESCRIPTION OF THE INVENTION

Figure 1:
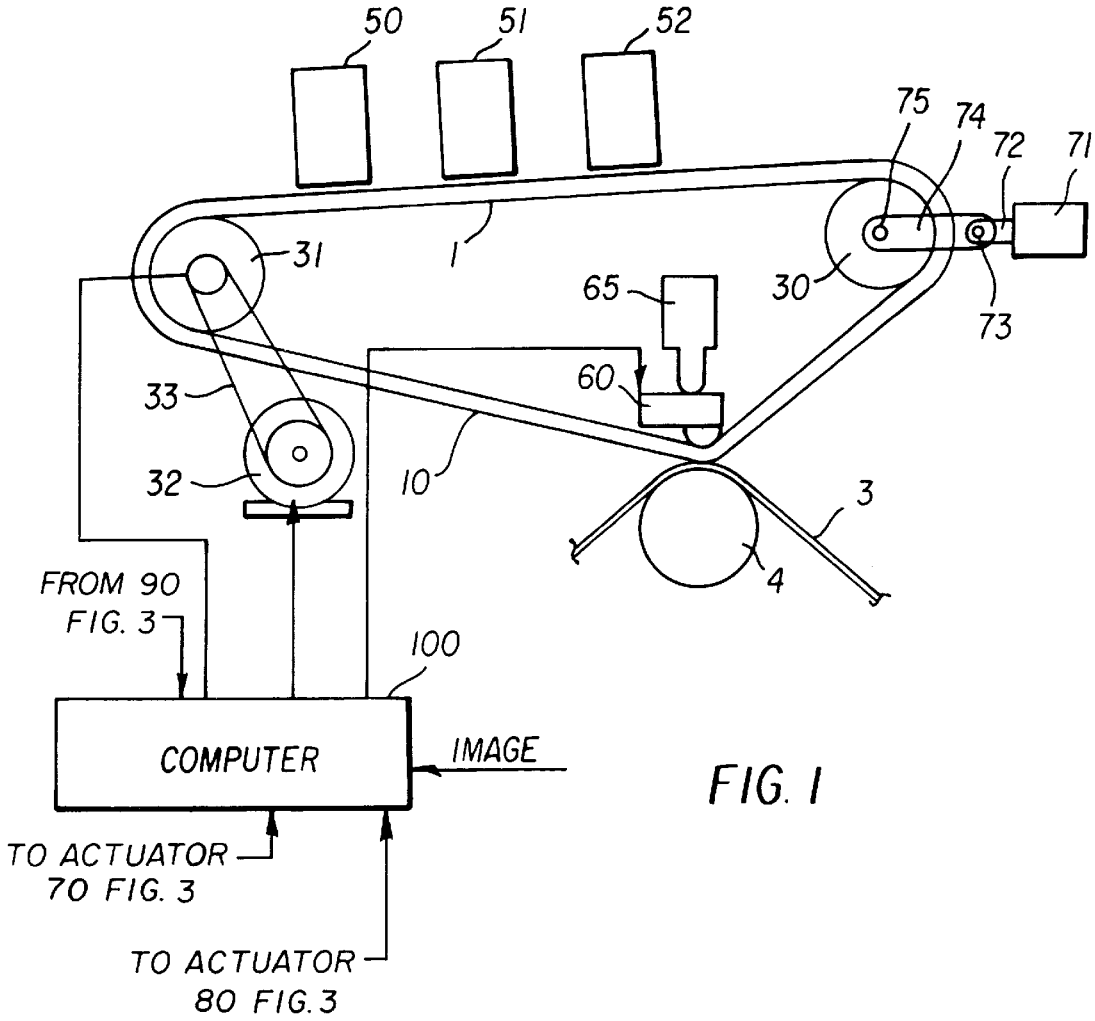
FIG. 1 shows a cross-sectional view of an apparatus for thermal printing with a re-inkable belt.

Turning to FIG. 1, a cross-sectional view of an apparatus for thermal printing with a re-inkable belt 1 is shown. A re-inkable belt 1 is shown which acts as the donor for thermally printed images. It will be understood by those skilled in the art that the term "ink" includes all manner of colorants and stains, including dispersions of pigments in common solvents, or solutions of dyes in such solvents. The solvents used may be water, or may be organic solvents such as alcohols, ketones, esters, ethers, hydrocarbons, and mixtures of the same. Cyan, magenta, and yellow re-ink stations 50, 51, and 52 re-ink the re-inkable belt 1, in patches of cyan, magenta and yellow color. The inks are then transferred by the action of the thermal print head 60 to the moveable receiver 3. For an example of structure for re-inking belts, see commonly assigned U.S. Pat. No. 5,692,844, the disclosure of which is hereby incorporated by reference. Also see the above-identified cross reference to related applications. The term "re-inkable" means that colorant, after imagewise usage, can be reapplied to the re-inkable belt 1 belt which is reusable. The re-inkable belt 1 is driven at printing speed with an electric motor 32 which drives the transport rollers 30 and 31 with a speed reduction timing belt 33. The electric motor 32 is controlled by a computer 100, which also controls the timing and power to the thermal print head 60 in accordance with the digital image to be printed. Heat generated at the thermal print head 60 migrates through the re-inkable belt 1 to the ink transfer layer 10 deposited by cyan, magenta and yellow re-ink stations 50, 51, and 52. The heat effects the transfer of ink to the moveable receiver 3. During the ink transfer, a platen drive roller 4 supports the moveable receiver 3 so that a close contact nip is established between the re-inkable belt 1 and the moveable receiver 3. Those skilled in the art will appreciate that the heat needed for image transfer could also be provided by a radiation source such as a laser.

Figure 2:
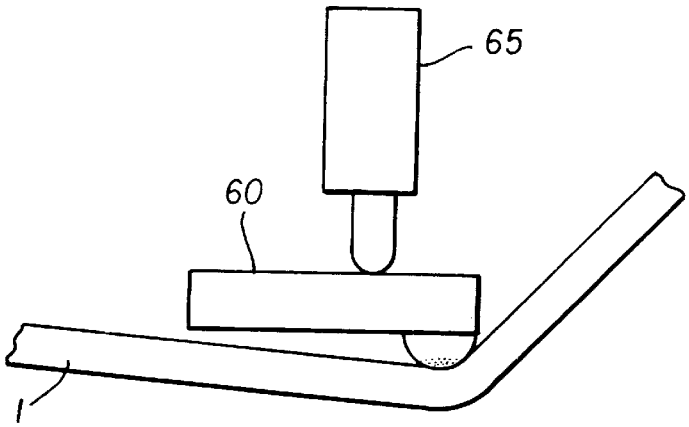
FIG. 2 shows an enlarged view of the printing head of FIG. 1 showing the re-inkable belt.

FIG. 2 shows an enlarged view of the printing station of FIG. 1. Thermal distortion of the re-inkable belt 1 is caused by the uneven heating of the re-inkable belt 1 by the thermal print head 60 in accordance with the dark and light areas of the image being printed. The lateral distortion caused by the preferential shrinkage or expansion of one side of the belt will eventually cause the belt to steer to one side and "walk" off the transport rollers 30 and 31. Pressure actuators 65 compensate for the thermal distortion of the belt by applying more pressure to one side or the other of the thermal print heat 60, thus preventing the unwanted side to side movement of the re-inkable belt 1 on the transport rollers 30 and 31. The pressure actuator 65 can be made in many ways. In a preferred embodiment of the invention the actuator includes a solenoid coil which drives a piston to apply pressure to the print heat 60 in proportion to the driving current of the solenoid. The driving current is in turn controlled by the computer 100. Such mechanisms are well known to those skilled in the art of mechanical design.

Figure 3:
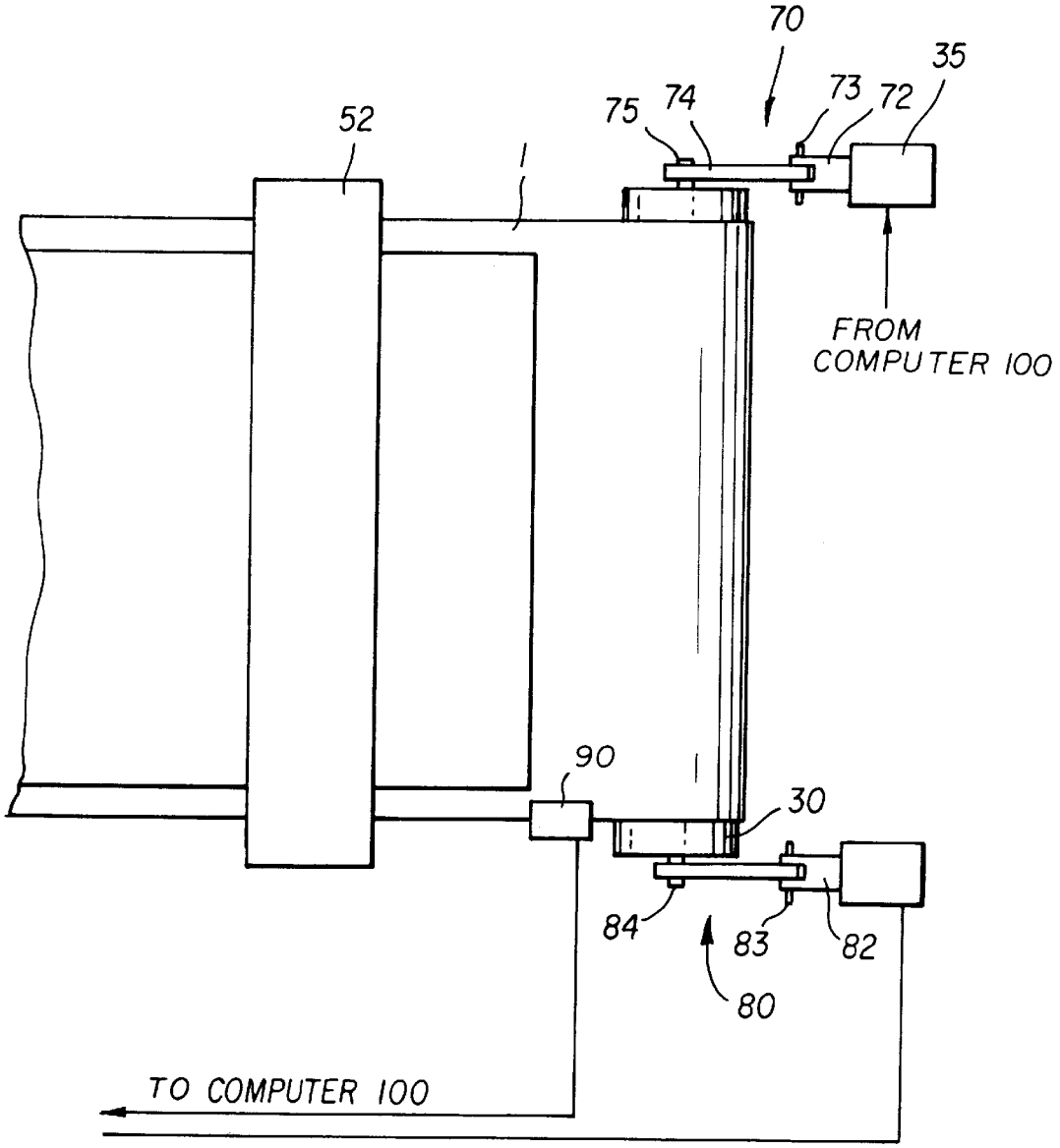
FIG. 3 shows a top view of a pair of steering actuators for compensating for the lateral distortion of the re-inkable belt.

FIG. 3 shows a top view of an alternative method of steering the re-inkable belt 1. In this case, a pair of steering actuators 70 and 80 apply tension to the re-inkable belt 1. Differentially higher tension applied to one side of the belt over the other provides a steering force to compensate for the thermal distortion 20 of the re-inkable belt 1. Each steering actuator 70 and 80 includes driver 71 and 81 connected to a rod 72 and 82 which is in turn connected to a link 74 and 84 by a pin 73 and 83. The link connects to and applies force to the axle 75 of the transport roller 30.

Figure 4:
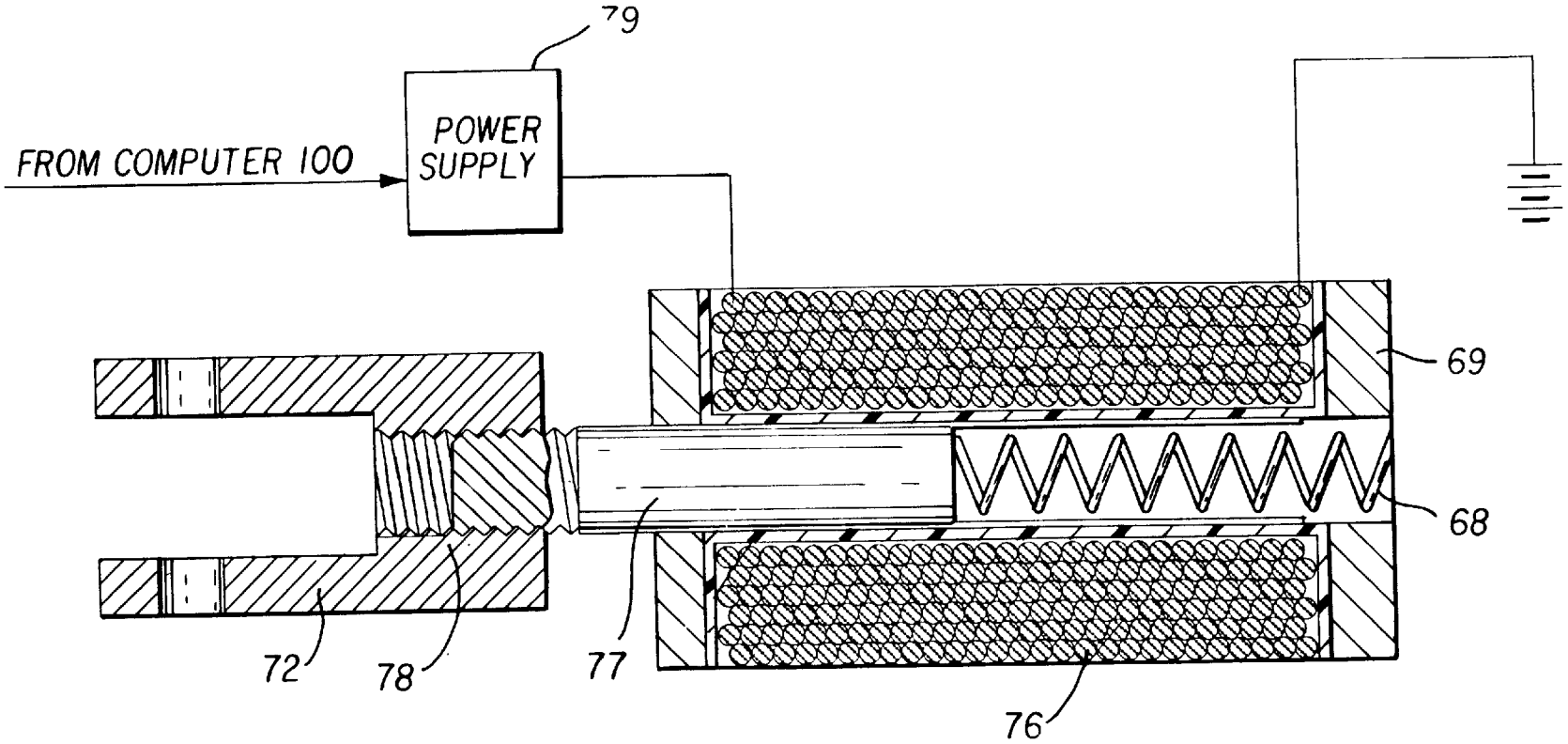
FIG. 4 shows a cross section view of one of the steering actuators of FIG. 3.

FIG. 4 shows a cross section view of the actuator 35. A spool 69 contains a coil 76 of electrical wire which acts as a solenoid when supplied with electrical current from the power supply 79. The magnetic field generated by the activated coil acts on the moveable iron rod 77 to pull the rod further into the spool, generating a force on the clevis 78 which is threaded into the rod 72. The force is then transmitted to the transport roller 30 as described in the previous paragraph. A spring 68 urges the moveable iron rod 77 out of the spool, providing movement in both directions. A sensor 90 (see FIG. 3) detects the position of the edge of the re-inkable belt 1 and produces a signal which indicates which lateral direction the web is moving in response to distortion caused by stresses such as temperature changes. Mechanical stresses can also distort the position of the re-inkable belt 1. These signals from the sensor are communicated to the computer 100 which, in turn, computes compensation signals which are selectively applied to the actuators 70 and 80 to move opposite portions of the transport roller to different positions causing the endless belt re-inkable belt to move laterally along the surface of the transport roller to compensate for lateral distortion of the re-inkable belt 1. The lateral distortions are caused by heat expansion and shrinkage of the re-inkable belt 1 which cause increased tension on one side of the belt or the other, thus causing the belt to "walk" to one side or the other during transport. It will be understood that the computer 100 calculates which one of the actuators should be activated and the extent of the actuation to compensate for lateral distortion of the position of the re-inkable belt. It will be understood that the distortion can be a physical displacement of the belt along with surface of the transport roller or a physical change in the size of the re-inkable belt 1 caused by temperature changes or a combination thereof.

Although the image thermal print head 60 is shown as a resistive heat printer, it is also possible to print using radiant heating, for example, from a laser beam. When radiant heating is used to form an image, along with the colorants that are added at the re-inking stations 50, 51, and 52 materials should be provided that are non-luminescent absorbers that produce heat by the process known in the art of photochemistry as internal conversion. Such an absorber may be a dye, a pigment, a metal, a metal oxide, or a dichroic stack of materials that absorb radiation by virtue of their refractive indexes and thickness. Dyes are suited for this purpose and may be present in particulate form or preferably substantially in molecular dispersion. Especially preferred are dyes absorbing in the IR region of the spectrum. Examples of such dyes may be found in Matsuoka, M., Infrared Absorbing Dyes, Plenum Press, New York, 1990, in Matsuoka, M., Absorption Spectra of Dyes for Diode Lasers, Bunshin Publishing Co., Tokyo, 1990, in U.S. Pat. No. 4,833,124 (Lum), U.S. Pat. No. 4,912,083 (Chapman et al.), U.S. Pat. No. 4,942,141 (DeBoer et al.), U.S. Pat. No. 4,948,776 (Evans et al.), U.S. Pat. No. 4,948,777 (Evans et al.), U.S. Pat. No. 4,948,778 (DeBoer), U.S. Pat. No. 4,950,639 (DeBoer), U.S. Pat. No. 4,952,552 (Chapman et al.), U.S. Pat. No. 5,023,229 (Evans et al.), U.S. Pat. No. 5,024,990 (Chapman et al.), U.S. Pat. No. 5,286,604 (Simmons), U.S. Pat. No. 5,340,699 (Haley et al.), U.S. Pat. No. 5,401,607 (Takiff et al.) and in European Patent 568,993 (Yamaoka et al.). Additional dyes are described in Bello, K. A. et al., J. Chem. Soc., Chem. Commun, 452 (1993) and U.S. Pat. No. 5,360,694 (Thien et al.). IR absorbers marketed by American Cyanamid or Glendale Protective Technologies, Inc., Lakeland, Fla., under the designation CYASORB IR-99, IR-126 and IR-165 may also be used, as disclosed in U.S. Pat. No. 5,156,938 (Foley et al.). Further examples may be found in U.S. Pat. No. 4,315,983 (Kawamura et al.), U.S. Pat. No. 4,415,621 (Specht et al.), U.S. Pat. No. 4,508,811 (Gravesteijn et al.), U.S. Pat. No. 4,582,776 (Matsui et al.), and U.S. Pat. No. 4,656,121 (Sato et al.). In addition to conventional dyes, U.S. Pat. No. 5,351,617 (Williams et al.) describes the use of infrared-absorbing conductive polymers. As will be clear to those skilled in the art, not all the dyes described will be suitable for every construction. Such dyes will be chosen for solubility in, and compatibility with, the specific polymer, sublimable material, and diffusion solvent in question.

In a preferred embodiment of the invention the photothermal conversion layer is coated on the re-inkable belt 1, as a thin metal layer overcoated with an antireflection layer so that substantially all of the writing radiation will be absorbed and converted into heat. A preferred material is titanium with an optical density of two or more overcoated with an effective quarter wave thickness of titanium dioxide. This combination reduces the reflection of the titanium to less than 10%, while providing absorption of the writing radiation of better than 90%. In addition to providing heat for the transfer of the special color from the re-inkable belt to the moveable receiver 3, it is important that the photothermal conversion material be chosen so that it does not contaminate the colors that are transferred to the moveable receiver 3. The colorants used in this invention may be dispersions of pigments in common solvents, or solutions of dyes in such solvents. The liquid colorants that feed the cyan, magenta and yellow re-ink stations 50, 51, and 52 of this invention are commonly called inks by those skilled in the art. Examples of such inks may be found in U.S. Pat. No. 5,611,847 by Gustina, Santilli and Bugner. Inks may also be found in the following commonly assigned U.S. Pat. Nos. 5,679,139; 5,679,141; 5,679,142; and 5,698,018, and in U.S. patent application Ser. No. 09/034,676 filed Mar. 4, 1998 to Martin, the disclosure of which is incorporated herein by reference. In a preferred embodiment of the invention the solvent is water. Colorants such as the Ciba Geigy Unisperse Rubine 4BA-PA, Unisperse Yellow RT-PA, and Unisperse Blue GT-PA are also preferred embodiments of the invention. Preferred examples of dyes used to make solution inks include those listed in Venkataraman, The Chemistry of Synthetic Dyes; Academic Press, 1970: Vols. 1–4 and The Colour Index Society of Dyers and Colourists, Yorkshire, England, Vols. 1–8. Examples of suitable dyes include cyanine dyes (e.g., streptocyanine, merocyanine, and carbocyanine dyes), squarylium dyes, oxonol dyes, anthraquinone dyes, diradical dicationic dyes, and polycyclic aromatic hydrocarbon dyes. Similarly, pigments can be included within the thermal mass transfer material to impart color and/or fluorescence. Examples are those known for use in the imaging arts including those listed in the Pigment Handbook; Lewis, P. A., Ed.; Wiley, New York, 1988, or available from commercial sources such as Hilton-Davis, Sun Chemical Co., Aldrich Chemical Co., and the Imperial Chemical Industries, Ltd. Heating the color re-inkable belt to thermally transfer color in the method of this invention is accomplished by an thermal resistive heater elements commonly referred to as a thermal head shown as 60 in FIG. 1. An intense light source of short duration may also be used to provide heat. The short exposure minimizes heat loss by conduction and will improve thermal efficiency. U.S. Pat. No. 5,491,046, "Method of Imaging a Lithographic Printing Plate", by DeBoer, et al, describes the efficiency improvement with short exposure for a laser thermal process in detail. Suitable light sources include flashlamps and lasers. It is advantageous to employ light sources which are relatively richer in infrared than ultraviolet wavelengths to minimize photochemical effects and maximize thermal efficiency. Therefore, when a laser is used it is preferred that it emit in the infrared or near infrared, especially from about 700 to 1200 nm. Suitable laser sources in this region include Nd:YAG, Nd:YLF and semiconductor lasers. The preferred lasers for use in this invention include high power (>100 mW) single mode laser diodes, fiber-coupled laser diodes, and diode-pumped solid state lasers (e.g. Nd:YAG, and Nd:YLF), and the most preferred lasers are diode lasers which can be directly modulated by changing the electrical currant supplied to the laser. The material chosen for the belt 1 of this invention should be durable, flexible, and capable of uniform re-inking by the colorants. Exemplary materials are thin metal webs such as stainless steel, aluminum and titanium. Polymeric materials may also be employed, provided they can survive high temperature localized heating. An exemplary material is the thermoset polyamide resin Kapton, sold by the DuPont Corporation. Polydimethylsiloxane webs are also useful. To provide rapid dye diffusion into and saturation of the ink transfer layer 10 on the re-inkable belt 1, the ink transfer layer 10 should be composed of a polymer that is rapidly wet and swelled by the solvent of the ink. In addition, the polymeric layer should be crosslinked into a matrix so it will not dissolve in the ink solvent. Exemplary polymers for this purpose are polyvinyl butyral and polyvinyl acetal.

The invention has been described in detail, with particular reference to certain preferred embodiments thereof, but it should be understood that variations and modifications can be effected with the spirit and scope of the invention.

PARTS LIST

| | |
|---|---|
| 1 | re-inkable belt |
| 3 | moveable receiver |
| 4 | platen drive roller |
| 10 | ink transfer layer |
| 20 | thermal distortion |
| 30 | transport roller |
| 31 | transport roller |
| 32 | electric motor |
| 33 | speed reduction timing belt |
| 35 | actuator |
| 50 | cyan re-ink station |
| 51 | magenta re-ink station |
| 52 | yellow re-ink station |
| 60 | thermal print head |
| 65 | head pressure actuator |
| 68 | spring |
| 69 | spool |
| 70 | left steering actuator |
| 71 | driver |
| 72 | rod |
| 73 | pin |
| 74 | link |
| 75 | axle |
| 76 | solenoid coil |
| 77 | iron rod |
| 78 | clevis |
| 79 | power supply |
| 80 | right steering actuator |
| 81 | driver |
| 82 | rod |
| 83 | pin |
| 84 | link |
| 90 | sensor |
| 100 | computer |

What is claimed is:

1. Color printing apparatus for compensating for lateral distortion of a re-inkable belt, the re-inkable belt being moveable along an endless path and trained about a transport roller and a platen roller including an ink transfer layer wherein ink is transferred by the actuation of a print head to a moveable receiver and replenished in the endless belt comprising:

a) means for causing the moveable receiver to move into ink transfer relationship with the re-inkable belt at a nip position between the platen roller and the print head for transferring ink imagewise from the re-inkable belt to the receiver;

b) means for replenishing depleted ink on the re-inkable belt; and c) means including two spaced actuators which when actuated adjustably applying tension at two spaced locations to the print head to laterally displace the re-inkable belt, a sensor for determining the position of the re-inkable belt, and means coupled to the sensor for selectively actuating the spaced actuators so as to laterally position the re-inkable belt along the surface of the platen roller to compensate for lateral distortion of the re-inkable belt.

* * * * *